US011970929B2

(12) United States Patent
Gillan et al.

(10) Patent No.: US 11,970,929 B2
(45) Date of Patent: Apr. 30, 2024

(54) METHODS AND APPARATUS TO CREATE AND IMPLEMENT A STEERING COMMAND FOR A ROTARY STEERABLE SYSTEM

(71) Applicant: Nabors Drilling Technologies USA, Inc., Houston, TX (US)

(72) Inventors: Colin Gillan, Houston, TX (US); Mohammed Alsaqi, Houston, TX (US)

(73) Assignee: NABORS DRILLING TECHNOLOGIES USA, INC., Houston, TX (US)

( * ) Notice: Subject to any disclaimer, the term of this patent is extended or adjusted under 35 U.S.C. 154(b) by 323 days.

(21) Appl. No.: 17/684,659

(22) Filed: Mar. 2, 2022

(65) Prior Publication Data

US 2023/0279765 A1 Sep. 7, 2023

(51) Int. Cl.

| | |
|---|---|
| ***E21B 44/00*** | (2006.01) |
| ***E21B 7/04*** | (2006.01) |
| ***E21B 47/024*** | (2006.01) |

(52) U.S. Cl.

CPC ..... *E21B 44/00* (2013.01); *E21B 7/04* (2013.01); *E21B 47/024* (2013.01); *E21B 44/005* (2013.01)

(58) Field of Classification Search

CPC ..... E21B 44/00

See application file for complete search history.

(56) References Cited

U.S. PATENT DOCUMENTS

| | | | | |
|---|---|---|---|---|
| 2011/0308794 | A1* | 12/2011 | Bittar | E21B 47/0228 166/254.2 |
| 2014/0049401 | A1* | 2/2014 | Tang | E21B 44/00 340/853.6 |
| 2021/0363828 | A1* | 11/2021 | Zalluhoglu | E21B 44/005 |
| 2022/0170359 | A1* | 6/2022 | Boualleg | G06N 20/20 |
| 2023/0038752 | A1* | 2/2023 | Hamzah | E21B 44/00 |

* cited by examiner

*Primary Examiner* — Suresh Suryawanshi

(74) *Attorney, Agent, or Firm* — Haynes and Boone, LLP

(57) ABSTRACT

A method of identifying a steering command for a rotary steerable system ("RSS") that includes identifying, by one or more processors, a solution arc for an upcoming drilling segment; automatically identifying, by the one or more processors and in response to the identification of the solution arc, the steering command for the RSS; and automatically identifying, by the one or more processor and in response to the identification of the steering command, downlink commands to be sent to the RSS. Automatically identifying, by the one or more processors and in response to the identification of the solution arc, the steering command for the RSS comprises: accessing a table that models a relationship between dogleg severity and a percentage of steering force; and identifying, using the table, the target steering force associated with the target dogleg severity.

20 Claims, 6 Drawing Sheets

400

| PAD/STEERING FORCE (%) | DOGLEG SEVERITY (deg/100 ft) |
|---|---|
| 10% | 2.0 |
| 20% | 2.2 |
| 30% | 2.4 |
| 40% | 2.6 |
| 50% | 2.8 |
| 60% | 3.0 |
| 70% | 3.2 |
| 80% | 3.4 |
| 90% | 3.6 |
| 100% | 3.8 |

Generated: 11/17/21 17:20 *BHL MD 9124 - RSS: Steer 95 ft. on Vector - 55 HS | Pad Force-60% | ROP ~300ft/hr | DLS 3.00 [W]*

Ignore | Accept | Override

FIG. 4

| PAD FORCE % | PLAN DLS | ACTUAL 1 | ACTUAL 2 | ACTUAL 3 |
|---|---|---|---|---|
| 10.0 | 1.6 | 1.3 | 1.2 | 1.8 |
| 20.0 | 3.2 | 2.7 | 2.3 | 3.6 |
| 30.0 | 4.8 | 4.0 | 3.5 | 5.3 |
| 40.0 | 6.4 | 5.4 | 4.7 | 7.1 |
| 50.0 | 8.0 | 6.7 | 5.8 | 8.9 |
| 60.0 | 9.6 | 8.0 | 7.0 | 10.7 |
| 70.0 | 11.2 | 9.4 | 8.1 | 12.4 |
| 80.0 | 12.8 | 10.7 | 9.3 | 14.2 |
| 90.0 | 14.4 | 12.1 | 10.5 | 16.0 |
| 100.0 | 16.0 | 13.4 | 11.6 | 17.8 |
| | | RUN 1 | RUN 2 | RUN 3 |

FIG. 6

| PAD FORCE % | PLAN DLS | ACTUAL 1 | ACTUAL 2 | ACTUAL 3 | ACTUAL 4 | AVG |
|---|---|---|---|---|---|---|
| 10.0 | | 1.3 | 1.2 | 1.8 | 1.5 | 1.4 |
| 20.0 | | 2.7 | 2.3 | 3.6 | 3.0 | 2.9 |
| 30.0 | | 4.0 | 3.5 | 5.3 | 4.5 | 4.3 |
| 40.0 | | 5.4 | 4.7 | **7.1** | 6.1 | 5.8 |
| 50.0 | | **6.7** | 5.8 | 8.9 | 7.6 | 7.2 |
| 60.0 | | 8.0 | 7.0 | 10.7 | 9.1 | 8.7 |
| 70.0 | | 9.4 | 8.1 | 12.4 | **10.6** | 10.1 |
| 80.0 | | 10.7 | **9.3** | 14.2 | 12.1 | 11.6 |
| 90.0 | | 12.1 | 10.5 | 16.0 | 13.6 | 13.0 |
| 100.0 | | 13.4 | 11.6 | 17.8 | 15.1 | 14.5 |
| | | RUN 1 | RUN 2 | RUN 3 | RUN 4 | |

METHODS AND APPARATUS TO CREATE AND IMPLEMENT A STEERING COMMAND FOR A ROTARY STEERABLE SYSTEM

FIELD OF THE DISCLOSURE

The disclosure herein relates to methods and apparatus for automatically creating and implementing steering commands for a rotary steerable system.

BACKGROUND

During a drilling operation, a directional driller is often presented with a target curvature for an upcoming drilling segment. The directional driller then identifies, based on the target curvature, target geometric instructions. To implement the target geometric instructions, the driller downlinks commands to a bottom hole assembly ("BHA") that includes a Rotary Steerable System ("RSS") so that tool settings associated with the RSS are changed, thereby ideally causing the BHA to drill in accordance with the geometric instructions. Often, the commands are sent to the RSS—or downlinked—via a downlink sequence that requires the adjustment of control parameters over a set period of time.

Conventionally, the directional driller identifies or calculates the target geometric instructions at least in part based on his or her past experiences, which can make the calculation of these target geometric instructions subjective. Additionally, after the geometric instructions have been identified, the driller inputs the command sequences that downlink the instructions to the downhole tool. Often, the driller will incorrectly input the command sequences, which results in the tool receiving the incorrect instructions. This can lead to the RSS drilling in an unwanted direction and/or lost time in correcting the mistake.

SUMMARY OF THE DISCLOSURE

In some embodiments, the present disclosure includes a method of identifying a steering command for a rotary steerable system ("RSS"), the method including: identifying, by one or more processors, a solution arc for an upcoming drilling segment; automatically identifying, by the one or more processors and in response to the identification of the solution arc, the steering command for the RSS; and automatically identifying, by the one or more processor and in response to the identification of the steering command, downlink commands to be sent to the RSS. In some embodiments, the method also includes displaying, on a user interface, a selectable option to approve the adoption of the steering command. In some embodiments, the method also includes displaying, on the user interface and with the selectable option to approve the adoption of the steering command, a reason for adopting the steering command. In some embodiments, the reason for adopting the steering command includes an indication that a correction is needed to return a bottom hole assembly (BHA) associated with the RSS into a threshold window surrounding a target drilling path. In some embodiments, the reason for adopting the steering command includes an indication that a correction is needed to return a BHA associated with the RSS to a target inclination. In some embodiments, the reason for adopting the steering command includes an indication that a correction is needed to return a BHA associated with the RSS to a target azimuth. In some embodiments, the method also includes automatically initiating, by the one or more processors and in response to selection of the option to approve the adoption of the steering command, the downlink commands. In some embodiments, the steering command includes a target dogleg severity and a target distance. In some embodiments, the steering command further includes a target steering force; and wherein automatically identifying, by the one or more processors and in response to the identification of the solution arc, the steering command for the RSS includes: accessing a table that models a relationship between dogleg severity and a percentage of steering force; and identifying, using the table, the target steering force associated with the target dogleg severity. In some embodiments, the method also includes updating, using the one or more processors, the table based on a plurality of historical steering forces and corresponding historical dogleg severities. In some embodiments, the steering command includes a target destination and a target orientation at the target destination.

In some embodiments, the present disclosure includes a system configured to identify a steering command for a rotary steerable system ("RSS"), the system including a non-transitory computer readable medium having stored thereon a plurality of instructions, wherein the instructions are executed with one or more processors so that the following steps are executed: identify, by one or more processors, a solution arc for an upcoming drilling segment; automatically identify, by the one or more processors and in response to the identification of the solution arc, the steering command for the RSS; and automatically identify, by the one or more processor and in response to the identification of the steering command, downlink commands to be sent to the RSS. In some embodiments, the instructions are executed with the one or more processors so that the following step is also executed: display, on a user interface, a selectable option to approve the adoption of the steering command. In some embodiments, the instructions are executed with the one or more processors so that the following step is also executed: display, on the user interface and with the selectable option to approve the adoption of the steering command, a reason for adopting the steering command. In some embodiments, the reason for adopting the steering command includes an indication that a correction is needed to return a bottom hole assembly (BHA) associated with the RSS into a threshold window surrounding a target drilling path. In some embodiments, the reason for adopting the steering command includes an indication that a correction is needed to return a BHA associated with the RSS to a target inclination. In some embodiments, the reason for adopting the steering command includes an indication that a correction is needed to return a BHA associated with the RSS to a target azimuth. In some embodiments, the instructions are executed with the one or more processors so that the following step is also executed: automatically initiate, by the one or more processors and in response to selection of the option to approve the adoption of the steering command, the downlink commands. In some embodiments, the steering command includes a target dogleg severity, a target distance, and a target steering force; and wherein automatically identifying, by the one or more processors and in response to the identification of the solution arc, the steering command for the RSS includes: accessing a table that models a relationship between dogleg severity and a percentage of steering force; and identifying, using the table, the target steering force associated with the target dogleg severity. In some embodiments, the steering command includes a target destination and a target orientation at the target destination.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

FIG. 4 is a table used during the method of FIG. 3 according to one or more aspects of the present disclosure.

FIG. 6 is a table related to the method of FIG. 3 according to another aspect of the present disclosure.

DETAILED DESCRIPTION

Figure 1:
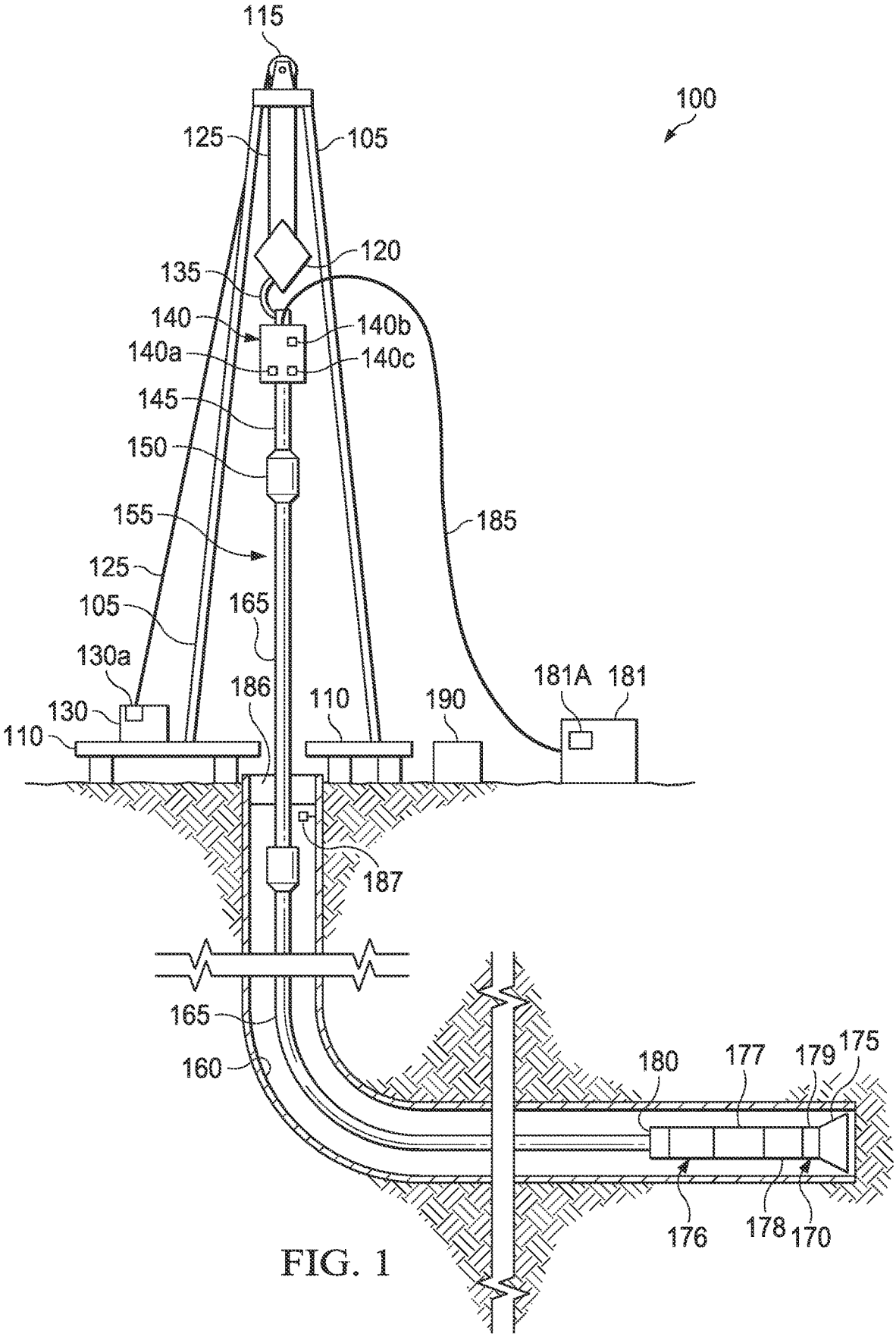
FIG. 1 is a schematic diagram of a drilling rig apparatus according to one or more aspects of the present disclosure.

It is to be understood that the present disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact and may also include embodiments in which additional features may be formed interposing the first and second features, such that the first and second features may not be in direct contact.

The apparatus and methods disclosed herein optimize the drilling process by identifying a target geometric instruction and the instruction combinations that, if implemented, alter a current rotary steerable system ("RSS") setting to a target RSS setting so that the target geometric instructions are implemented. Additionally, the apparatus and methods disclosed herein also uses feedback from past drilling segments when creating the target geometric instructions. In conventional systems, RSS commands have been built for the human user such that a command may increase or decrease an existing inclination. With the disclosed system, however, the logic may be expressed in terms of a virtual toolface and a steering force, combined into a steering vector where the magnitude is a pad force %, and the direction is a virtual toolface direction from 0-360. Generally, the disclosed system will be aware of the last RSS downlink command as it will be retained in software storage, but the last command is not essential to the creation of a new command.

Referring to FIG. 1, illustrated is a schematic view of an apparatus 100 demonstrating one or more aspects of the present disclosure. The apparatus 100 is or includes a land-based drilling rig. However, one or more aspects of the present disclosure are applicable or readily adaptable to any type of drilling rig, such as jack-up rigs, semisubmersibles, drill ships, coil tubing rigs, well service rigs adapted for drilling and/or re-entry operations, and casing drilling rigs, among others within the scope of the present disclosure.

Apparatus 100 includes a mast 105 supporting lifting gear above a rig floor 110. The lifting gear includes a crown block 115 and a traveling block 120. The crown block 115 is coupled at or near the top of the mast 105, and the traveling block 120 hangs from the crown block 115 by a drilling line 125. One end of the drilling line 125 extends from the lifting gear to draw works 130, which is configured to reel out and reel in the drilling line 125 to cause the traveling block 120 to be lowered and raised relative to the rig floor 110. The draw works 130 may include a rate of penetration ("ROP") sensor 130*a*, which is configured for detecting an ROP value or range, and a surface control system to feed-out and/or feed-in of a drilling line 125. The other end of the drilling line 125, known as a dead line anchor, is anchored to a fixed position, possibly near the draw works 130 or elsewhere on the rig.

A hook 135 is attached to the bottom of the traveling block 120. A drive system 140 is suspended from the hook 135. A quill 145, extending from the drive system 140, is attached to a saver sub 150, which is attached to a drill string 155 suspended within a wellbore 160. Alternatively, the quill 145 may be attached to the drill string 155 directly. The term "quill" as used herein is not limited to a component which directly extends from the drive system 140, or which is otherwise conventionally referred to as a quill. For example, within the scope of the present disclosure, the "quill" may additionally or alternatively include a main shaft, a drive shaft, an output shaft, and/or another component which transfers torque, position, and/or rotation from the top drive or other rotary driving element to the drill string, at least indirectly. Nonetheless, albeit merely for the sake of clarity and conciseness, these components may be collectively referred to herein as the "quill." In the example embodiment depicted in FIG. 1, the drive system 140 is utilized to impart rotary motion to the drill string 155. However, aspects of the present disclosure are also applicable or readily adaptable to implementations utilizing other drive systems, such as a power swivel, a rotary table, a coiled tubing unit, a downhole motor, and/or a conventional rotary rig, among others.

The apparatus 100 may additionally or alternatively include a torque sensor 140*a* coupled to or otherwise associated with the drive system 140. The torque sensor 140*a* may alternatively be located in or associated with the BHA. The torque sensor 140*a* may be configured to detect a value or range of the torsion of the quill 145 and/or the drill string 155 (e.g., in response to operational forces acting on the drill string). The drive system 140 may additionally or alternatively include or otherwise be associated with a speed sensor 140*b* configured to detect a value or range of the rotational speed of the quill 145. The drive system 140, the draw works 130, the crown block 115, the traveling block 120, drilling line or dead line anchor may additionally or alternatively include or otherwise be associated with a weight-on-bit ("WOB") or hook load sensor 140*c* (e.g., one or more sensors installed somewhere in the load path mechanisms to detect and calculate WOB, which can vary from rig-to-rig).

The WOB sensor 140*c* may be configured to detect a WOB value or range, where such detection may be performed at the drive system 140, the draw works 130, or other component of the apparatus 100. Generally, the hook load sensor 140*c* detects the load on the hook 135 as it suspends the drive system 140 and the drill string 155.

The drill string 155 includes interconnected sections of drill pipe or tubulars 165 and a BHA 170, which includes a drill bit 175. The BHA 170 may include one or more measurement-while-drilling ("MWD") or wireline conveyed instruments 176, flexible connections 177, an RSS 178 that includes adjustment mechanisms 179 for push-the-bit drilling or bent housing and bent subs for point-the-bit drilling, a downhole control system 180, stabilizers, and/or drill collars, among other components. One or more pumps of a mud pump system 181 may deliver drilling fluid to the drill string 155 through a hose or other conduit 185, which may be connected to the drive system 140. In some embodiments, a mud pump sensor 181*a* monitors the output of the mud pump system 181 and may measure the flow rate produced by the mud pump system 181 and/or a pressure produced by the mud pump system 181.

The downhole MWD or wireline conveyed instruments 176 may be configured for the evaluation of physical properties such as pressure, temperature, torque, weight-on-bit ("WOB"), vibration, inclination, azimuth, toolface orientation in three-dimensional space, and/or other downhole parameters. These measurements may be made downhole, stored in solid-state memory for some time, sent to the downhole control system 180, and downloaded from the instrument(s) at the surface and/or transmitted real-time to the surface. Data transmission methods may include, for example, digitally encoding data and transmitting the encoded data to the surface, possibly as pressure pulses in the drilling fluid or mud system, acoustic transmission through the drill string 155, electronic transmission through a wireline or wired pipe, and/or transmission as electromagnetic pulses. The MWD tools and/or other portions of the BHA 170 may have the ability to store measurements for later retrieval via wireline and/or when the BHA 170 is tripped out of the wellbore 160.

In some embodiments, the downhole control system 180 may be a stand-alone component that forms a portion of the BHA 170 or be integrated in the adjustment mechanism 179 or a sensor that forms a portion of the BHA 170.

In an example embodiment, the apparatus 100 may also include a rotating blow-out preventer ("BOP") 186, such as if the wellbore 160 is being drilled utilizing under-balanced or managed-pressure drilling methods. In such embodiment, the annulus mud and cuttings may be pressurized at the surface, with the actual desired flow and pressure possibly being controlled by a choke system, and the fluid and pressure being retained at the well head and directed down the flow line to the choke by the rotating BOP 186. The apparatus 100 may also include a surface casing annular pressure sensor 187 configured to detect the pressure in the annulus defined between, for example, the wellbore 160 (or casing therein) and the drill string 155. It is noted that the meaning of the word "detecting," in the context of the present disclosure, may include detecting, sensing, measuring, calculating, and/or otherwise obtaining data. Similarly, the meaning of the word "detect" in the context of the present disclosure may include detect, sense, measure, calculate, and/or otherwise obtain data.

Figures 2, 5:
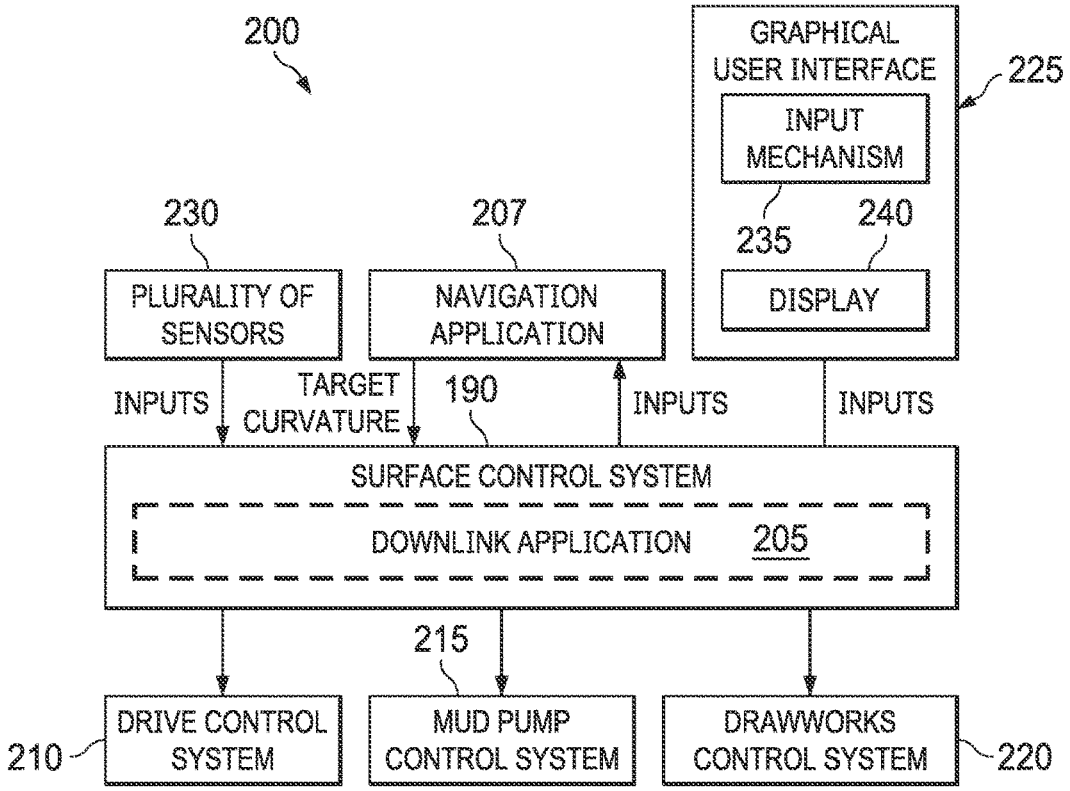
FIG. 2 is a diagrammatic illustration of a data flow involving at least a portion of the drilling rig apparatus of FIG. 1, according to one or more aspects of the present disclosure.
FIG. 5 is an illustration of a window displayed on a user interface during the method of FIG. 3 according to one or more aspects of the present disclosure.

FIG. 2 is a diagrammatic illustration of a data flow 200 involving at least a portion of the apparatus 100 according to one embodiment. Generally, the surface control system 190 is operably coupled to or includes a downlink application 205 that receives a target curvature for an upcoming drilling segment from a navigation application 207. The downlink application 205, based on the target curvature, identifies a geometric instruction that will create the target curvature and also identifies and selects a downlink command sequence that instructs the RSS 178 to change configuration to implement the geometric instruction. In some instances, the downlink application 205 presents the calculated geometric instruction for approval to a user. The downlink application 205 selects the downlink command sequences for implementation by the surface control system 190. The surface control system 190 instructs one or more of a drive control system 210, a mud pump control system 215, and a draw works control system 220 to implement the selected downlink command sequence to fluctuate top drive rotation, pump pressure, and flow rate.

In some embodiments, the surface control system 190 is, or forms a portion of, a computing system that is configured to control or assist in the control of one or more components of the apparatus 100. For example, the surface control system 190 may be configured to transmit operational control signals to the draw works 130, the drive system 140, the BHA 170 and/or the mud pump system 181. The surface control system 190 may be a stand-alone component installed near the mast 105 and/or other components of the apparatus 100. In an example embodiment, the surface control system 190 includes one or more systems located in a control room proximate the mast 105, such as the general-purpose shelter often referred to as the "doghouse" serving as a combination tool shed, office, communications center, and general meeting place. The surface control system 190 may be configured to transmit the operational control signals to the draw works 130, the drive system 140, the BHA 170, and/or the mud pump system 181 via wired or wireless transmission means.

In some embodiments, the downlink application 205 is an electronic application operably coupled, via the surface control system 190 or otherwise, to the drive control system 210, the mud pump control system 215, and the draw works control system 220, and is configured to send signals to each of the control systems 210, 215, and 220 to control the operation of the drive system 140, the mud pump system 181, and the draw works 130. The downlink application 205 may include a variety of sub modules, with each of the sub modules being associated with a predetermined workflow or recipe that executes a task from beginning to end. Often, the predetermined workflow includes a set of computer-implemented instructions for executing the task from beginning to end, with the task being one that includes a repeatable sequence of steps that take place to implement the task. As described below, the downlink application 205 may identify which instruction combination or downlink command sequence(s) the surface control system 190 should implement. In some embodiments, the downlink application 205 receives or accesses the current RSS settings. The current RSS settings may be the last settings input by the surface control system 190 or the last settings selected by an operator using a graphical user interface ("GUI") 225. In some embodiments, and as illustrated, the downlink application 205 and the surface control system 190 may be integral components of a single system. However, in other embodiments, the downlink application 205 is stored in a component that is physically spaced from the surface control system 190. In this instance, the downlink application 205 may be coupled to or accessed by the surface control system 190 via a wireless network or wired connection. In some embodiments, the downlink application 205 may produce a specific downlink command sequence to implement and displays the proposed instructions and/or commands on the GUI 225, where a user can review and approve of the proposed instructions and/or commands. In some embodiments, the user approves the proposed instructions and/or commands before the proposed instructions and/or commands are implemented by the surface control system 190.

In some embodiments, the navigation application 207 receives inputs from the surface control system 190 comprising of any one or more of the following: current BHA 170 location, existing drilling parameters, historical drilling parameters, and a historical BHA 170 location. In some embodiments, the navigation application 207 receives inputs such as a target drilling path, a drilling window, and/or other wellplan information. In some embodiments, the drilling window is a tolerance limit surrounding the target drilling path. In some embodiments, the navigation application 207 compares the current location of the BHA 170 to the target drilling path. The current location of the BHA 170 may be based on a calculated or predicted position. In some embodiments, the navigation application 207 calculates a target curvature for an upcoming drilling segment. Generally, the target curvature is identified in response to the current downhole location of the BHA 170 being off the target drilling path. In other embodiments, the target curvature is identified in response to the current downhole location of the BHA 170 being outside of the drilling window. In some embodiments, the target curvature is configured to steer the BHA 170 back to the target drilling path. In other embodiments, the target curvature is not identified in response to the calculated or predicted downhole location of the BHA 170 being off the target drilling path. Instead, the target curvature forms a portion of the target drilling path. Regardless, the navigation application 207 identifies the target curvature for an upcoming drilling segment.

In some embodiments the drive control system 210 includes the torque sensor 140*a*, the quill position sensor, the hook load sensor 140*c*, the pump pressure sensor, the MSE sensor, and the rotary RPM sensor, and a surface control system and/or other means for controlling the rotational position, speed and direction of the quill or other drill string component coupled to the drive system (such as the quill 145 shown in FIG. 1). The drive control system 210 is configured to receive a drive control signal from the downlink application 205, if not also from other components of the apparatus 100. The drive control signal directs the position (e.g., azimuth), spin direction, spin rate, and/or oscillation of the quill 145. The drive control system 210 is not required to include a top drive, but instead may include other drive systems, such as a power swivel, a rotary table, a coiled tubing unit, a downhole motor, and/or a conventional rotary rig, among others.

In some embodiments, the mud pump control system 215 includes a mud pump surface control system and/or other means for controlling the flow rate and/or pressure of the output of the mud pump system 181 and any associated sensors, such as the mud pump sensor 181*a*, for monitoring the output of the mud pump system 181.

In some embodiments, the draw works control system 220 includes the draw works surface control system and/or other means for controlling the feed-out and/or feed-in of the drilling line 125. Such control may include rotational control of the draw works (in v. out) to control the height or position of the hook 135 and may also include control of the rate the hook 135 ascends or descends.

As illustrated, the GUI 225 is operably coupled to the surface control system 190. The GUI 225 includes an input mechanism 235 for user-inputs. The input mechanism 235 may include a touch-screen, keypad, voice-recognition apparatus, dial, button, switch, slide selector, toggle, joystick, mouse, data base and/or other conventional or future-developed data input device. Such input mechanism 235 may support data input from local and/or remote locations. Alternatively, or additionally, the input mechanism 235 may include means for user-selection of input parameters, user-selection of settings, selecting to implement the selected instruction combination, and/or selecting a type of tool that forms a portion of the BHA 170, such as via one or more drop-down menus, input windows, etc. In general, the input mechanism 235 and/or other components within the scope of the present disclosure support operation and/or monitoring from stations on the rig site as well as one or more remote locations with a communications link to the system, network, local area network ("LAN"), wide area network ("WAN"), Internet, satellite-link, and/or radio, among other means. The GUI 225 may also include a display 240 for visually presenting information to the user in textual, graphic, or video form. The display 240 may also be utilized by the user to input input parameters in conjunction with the input mechanism 235. For example, the input mechanism 235 may be integral to or otherwise communicably coupled with the display 240. Depending on the implementation, the display 240 may include, for example, an LED or LCD display computer monitor, touchscreen display, television display, a projector, or other display device. The GUI 225 and the surface control system 190 may be discrete components that are interconnected via wired or wireless means. Alternatively, the GUI 225 and the surface control system 190 may be integral components of a single system.

A plurality of sensors 230 provide inputs or data to the surface control system 190 via wired or wireless transmission means. The plurality of sensors 230 may include the ROP sensor 130*a*; the torque sensor 140*a*; the quill speed sensor 140*b*; the hook load sensor 140*c*; the mud pump sensor 181*a*; the surface casing annular pressure sensor 187; a downhole annular pressure sensor; a shock/vibration sensor that is configured for detecting shock and/or vibration in the BHA 170; a toolface sensor configured to estimate or detect the current toolface orientation or toolface angle; a MWD WOB sensor configured to detect WOB at or near the BHA 170; a bit torque sensor that generates data indicative of the torque applied to the bit 175; the hook position sensor; a rotary RPM sensor; a quill position sensor; a pump pressure sensor; a MSE sensor; a bit depth sensor; and any variation thereof. The downhole annular pressure sensor may be configured to detect a pressure value or range in the annulus-shaped region defined between the external surface of the BHA 170 and the internal diameter of the wellbore 160, which may also be referred to as the casing pressure, downhole casing pressure, MWD casing pressure, or downhole annular pressure. These measurements may include both static annular pressure (pumps off) and active annular pressure (pumps on). However, in other embodiments the downhole annular pressure may be calculated using measurements from a plurality of other sensors located downhole or at the surface of the well. The toolface sensor may be or include a conventional or future-developed gravity toolface sensor which detects toolface orientation relative to the Earth's gravitational field. Alternatively, or additionally, the toolface sensor may be or include a conventional or future-developed magnetic toolface sensor which detects toolface orientation relative to magnetic north or true north.

In an example embodiment, a magnetic toolface sensor may detect the current toolface when the end of the wellbore is less than about 7° from vertical, and a gravity toolface sensor may detect the current toolface when the end of the wellbore is greater than about 7° from vertical. However, other toolface sensors may also be utilized within the scope of the present disclosure, including non-magnetic toolface sensors and non-gravitational inclination sensors. The toolface sensor may also, or alternatively, be or include a conventional or future-developed gyro sensor.

The plurality of sensors 230 may additionally or alternatively include an inclination sensor integral to the BHA 170 that is configured to detect inclination at or near the BHA 170. The plurality of sensors 230 may additionally or alternatively include an azimuth sensor integral to the BHA 170 that is configured to detect azimuth at or near the BHA 170. In some embodiments, the BHA 170 also includes another directional sensor (e.g., azimuth, inclination, toolface, combination thereof, etc.) that is spaced along the BHA 170 from a first directional sensor (e.g., the inclination sensor, the azimuth sensor). For example, and in some embodiments, the sensor is positioned in the MWD or wireline conveyed instruments 176 and the first directional sensor is positioned in the adjustment mechanism 179, with a known distance between them, for example 20 feet, configured to estimate or detect the current toolface orientation or toolface angle. The sensors may be spaced along the BHA 170 in a variety of configurations. The data detected by any of the sensors in the plurality of sensors 230 may be sent via electronic signal to the surface control system 190 via wired or wireless transmission.

The detection performed by the sensors described herein may be performed once, continuously, periodically, and/or at random intervals. The detection may be manually triggered by an operator or other person accessing a human-machine interface ("HMI") or GUI, or automatically triggered by, for example, a triggering characteristic or parameter satisfying a predetermined condition (e.g., expiration of a time period, drilling progress reaching a predetermined depth, drill bit usage reaching a predetermined amount, etc.). Such sensors and/or other detection means may include one or more interfaces which may be local at the well/rig site or located at another, remote location with a network link to the system.

Generally, the surface control system 190 and/or the navigation application 207 monitors, in real-time, tool settings and drilling operations relating to a wellbore; creates and/or modifies drilling instructions based on the monitored drilling operations; and monitors the responsiveness of drilling equipment used in the drilling operation. As used herein, the term "real-time" is thus meant to encompass close to real-time, such as within about 10 seconds, preferably within about 5 seconds, and more preferably within about 2 seconds. Near real-time can encompass an amount of time required to send a measured parameter from the BHA 170 to the surface control system 190 via wired or wireless methods.

Figure 3:
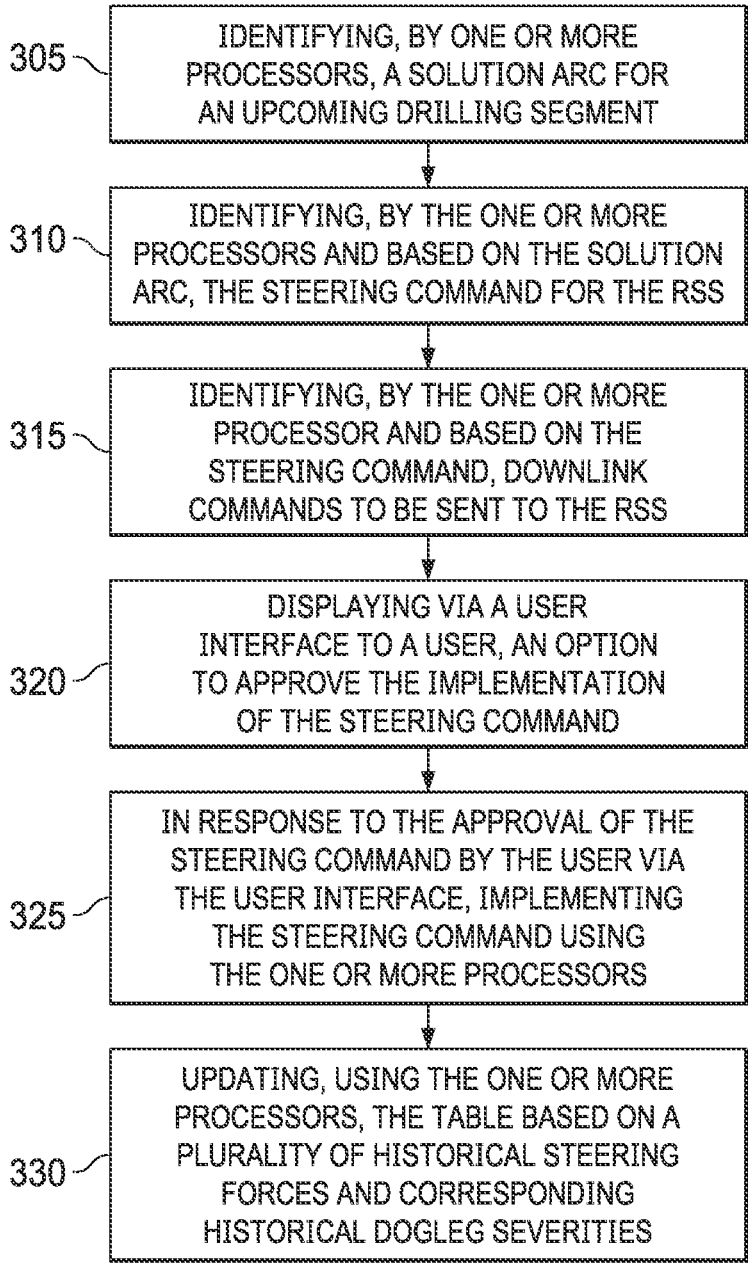
FIG. 3 is a flow chart diagram of a method according to one or more aspects of the present disclosure.

FIG. 3 is a flow chart showing an example method 300 of identifying a steering command for a rotary steerable system ("RSS") tool. It is understood that additional steps can be provided before, during, and after the steps of method 300, and that some of the steps described can be replaced or eliminated for other implementations of the method 300. In an example embodiment, the method 300 includes identifying, by one or more processors, a solution arc for an upcoming drilling segment at step 305; identifying, by the one or more processors and based on the solution arc, the steering command for the RSS at step 310; identifying, by the one or more processor and based on the steering command, downlink commands to be sent to the RSS at step 315; displaying via a user interface to a user, an option to approve the implementation of the steering command at step 320; in response to the approval of the steering command by the user via the user interface, implementing the steering command using the one or more processors at step 325; and updating, using the one or more processors, the table based on a plurality of historical steering forces and corresponding historical dogleg severities at step 330.

In some embodiments and at the step 305, the navigation application 207 identifies a solution arc or target curvature for an upcoming drilling segment. Generally, the navigation application 207 accesses and uses the inputs received by the surface control system 190 to compare a calculated or predicted downhole location of the BHA 170 with a target drilling path. Based on the comparison, the navigation application 207 will identify a solution arc for an upcoming drilling segment. In some instances, the solution arc is identified in response to the calculated or predicted downhole location of the BHA 170 being outside of a tolerance window that surrounds the target drilling path such that the solution arc is configured to steer the BHA 170 back towards the target drilling path. In other instances, the solution arc is not in response to the BHA 170 being outside of the tolerance window. Instead, the solution arc forms a portion of the target drilling path. Regardless, the navigation application 207 identifies the solution arc. In some embodiments, the solution arc is or includes a target dogleg severity over a predetermined distance, such as 95 ft.

In some embodiments and at step 310, the steering commands for the RSS are identified based on the solution arc. In some embodiments, the solution arc is translated into a steering command that is a steering vector. The steering vector has the components of a steering force and a toolface direction. In some embodiments, the steering command also includes a target ROP. In order to identify the ideal or target steering force, a relationship between steering force and dogleg severity ("DLS") is referenced. An example of a table that illustrates the relationship between steering force and DLS is illustrated in FIG. 4 and referenced by the numeral 400. In some embodiments, the relationship is a model relationship between the RSS pad force and the estimated DLS generated with each pad force or side force. Generally, RSS directional capabilities are matched to the planned well path section to be drilled and the curvature yield or DLS range of the RSS will be appropriately "sized" for the hole section being drilled. Because the relationship or model relationship between the RSS pad force and estimated DLS is accessible by the navigation application 207 and/or the downlink application 205, the navigation application 207 and/or the downlink application 205 calculates/identifies the target numerical values of the steering vector. For example, in the solution arc including a DLS of 3.0, a pad/steering force % of 60% would be identified using the table 400. As such, one example of a steering command when a 3.0 DLS is desired is "RSS: Steer 95 ft. on Vector 55 HS|Pad Force=60%|ROP ~300 ft/hr|DLS 3.00[W]." The "HS" indicates 55 degrees right of high side; "DLS 3.0" indicates a desired dogleg severity of 3.00; ROP ~300 ft/hr indicates a target rate of penetration being approximately 300 ft/hr; and the "[W]" indicates that the reason for the steering command is to return the BHA into the threshold window surrounding the target drilling path. Other indications include "[I]", which indicates that the reason for the steering command is to return the BHA to the target inclination, and "[A]", which indicates that the reason for the steering command is to return the BHA to the target azimuth. The return to the threshold window and/or target inclination/azimuth is considered a correction that is needed and the indicators of [W], [I], and [A] are reasons why the correction should be adopted.

In some embodiments and at step 315, the downlink application 205 identifies downlink commands to be sent to the RSS 178. In some embodiments, downlink commands are specific to the tools forming the RSS 178. In some embodiments, a plurality of preprogrammed downlink sequences is stored in or accessible by the downlink application 205, with the plurality of preprogrammed downlink sequences being the tool manufactures' recommended output values associated with the mud pump system 181 and/or the drive system 140. For example, one downlink command sequence may require a control parameter to alternate between two values every few seconds for a certain period of time. Each downlink command sequence may be identified by a particular command number and each downlink command sequence informs the RSS 178 of a change in settings. In some embodiments and during the step 315, the downlink application 205 identifies any instruction combination that would result in the RSS 178 settings being changed to produce the steering vector.

In some embodiments and at step 320, an option to approve the implementation or adoption of the steering command is displayed to a user. In some embodiments, the downlink application 205 displays a window on the GUI 225 that requests the user to accept, override, or ignore the suggested steering command. An example of such a window is illustrated in FIG. 5 and referenced by the numeral 500. As illustrated, the example window includes a time stamp, a bottom hole location ("BHL") measured depth ("MD") of 9124, the steering command of "RSS: Steer 95 ft. on Vector=55 HS|Pad Force=60%|ROP ~300 ft/hr|DLS 3.00 [W]"; and selectable buttons of Ignore, Accept, and Override. In some embodiments and when the selectable button of Accept is selected, the downlink application 205 automatically implements the identified steering commands.

In some embodiments and at step 325, in response to the approval of the steering command by the user via the user interface, the apparatus 100 implements the steering command. Generally, implementing the steering command includes downlinking the identified downlink command sequence. In some embodiments, the identified downlink command sequence is automatically executed, with user approval, using the surface control system 190. That is, the downlink command sequence(s) of the approved steering command are executed by the surface control system 190. In some embodiments, the downlink application 205 instructs the surface control system 190 to implement the downlink command sequence(s) of the approved steering command to change the current settings of the RSS to the settings associated with the steering command. In some embodiments, the downlink sequence, when initiated, requires alteration of any one or more of the following: mud flow rate, RPM of the top drive 140, and mud pump pressure. In some embodiments, the downlink command sequence of the approved steering command requires the mud pump system 181 to alter parameters to vary the mud pump pressure according to the downlink command sequence. In some embodiments, the downlink command sequence of the approved steering command alters functioning of the top drive 140. In some embodiments, the downlink command sequence of the approved steering command alters the functioning of the draw works 130.

Figures 7, 8:
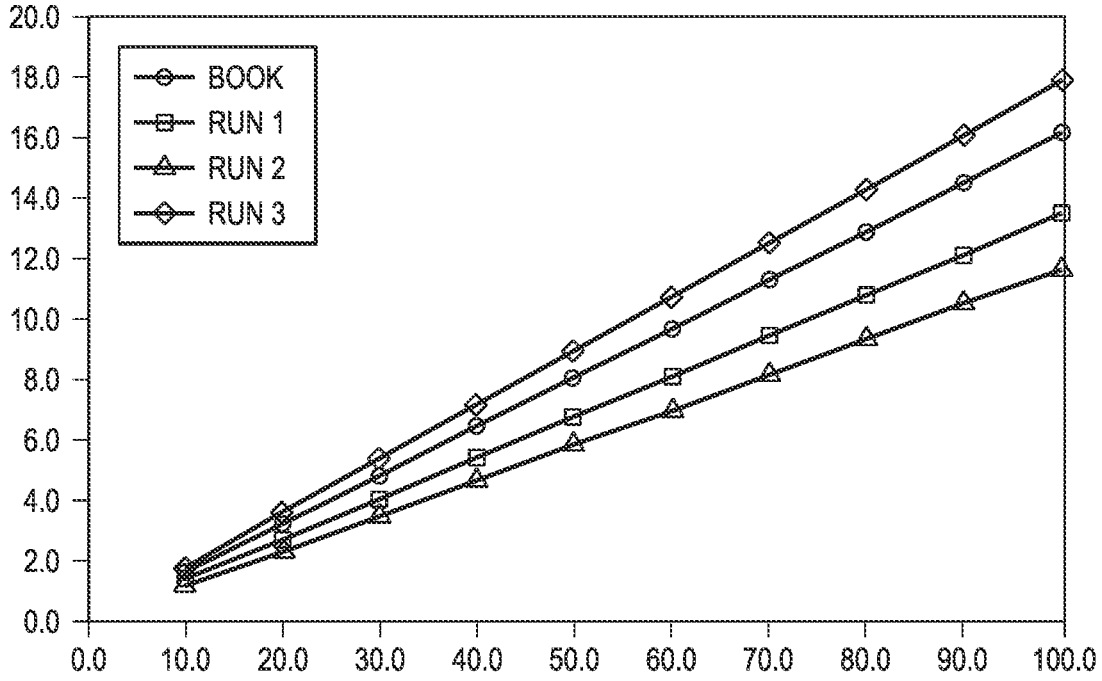
FIG. 7 is a graph related to the method of FIG. 3 according to another aspect of the present disclosure.
FIG. 8 is a table related to the method of FIG. 3 according to another aspect of the present disclosure.

In some embodiments and at step 330, the downlink application 205 updates the table 400 based on a plurality of historical steering forces, historical rates of penetration (ROP), and corresponding historical dogleg severities. Including the historical ROP in the dogleg severity to steering force calculation allows for work done to be considered and taken into account. Work done can be defined as a force applied over a period of time. If a horizontal push force of 10 pounds force is applied to a block of wood on a surface, the end result position of the block will be different after 30 seconds of force application than it would be after 60 seconds of force application. Similarly for an RSS, if it takes 20 minutes to drill 95 ft with a 60% steering force, this will produce a certain deviation, but if it takes 35 minutes to drill the same 95 ft, the end result deviation will be more, as more work has been done. Therefore, and in some embodiments, the ROP at which the DLS is achieved along with the steering force is taken into account in the relationship between DLS required and what steering force to set in the RSS. In some embodiments, the ROP average should be calculated for all sampled DLS to Steering Force observations and used in the published advisory. FIG. 6 illustrates a table 600 used and/or created by the downlink application 205. In some embodiments, at least a portion of the table 600 is associated with a model relationship between DLS and specified Steering Force. As illustrated, the "Plan DLS" column is populated with a set of start values from the "book" values expected for each level of pad force percentage. These initial values can be modified after the RSS makes footage under a steering command. The percentage of pad force used in the RSS and the resultant DLS generated by this run is entered in the table as Actual 1. The actual DLS generated by the first run with a certain ROP causes the table 600 values on the DLS to be adjusted proportionally across the range of pad force % as in the Actual 1 column of the table 600. FIG. 7 illustrates a graphic illustration 700 of adjustments of multiple runs.

Figure 9:
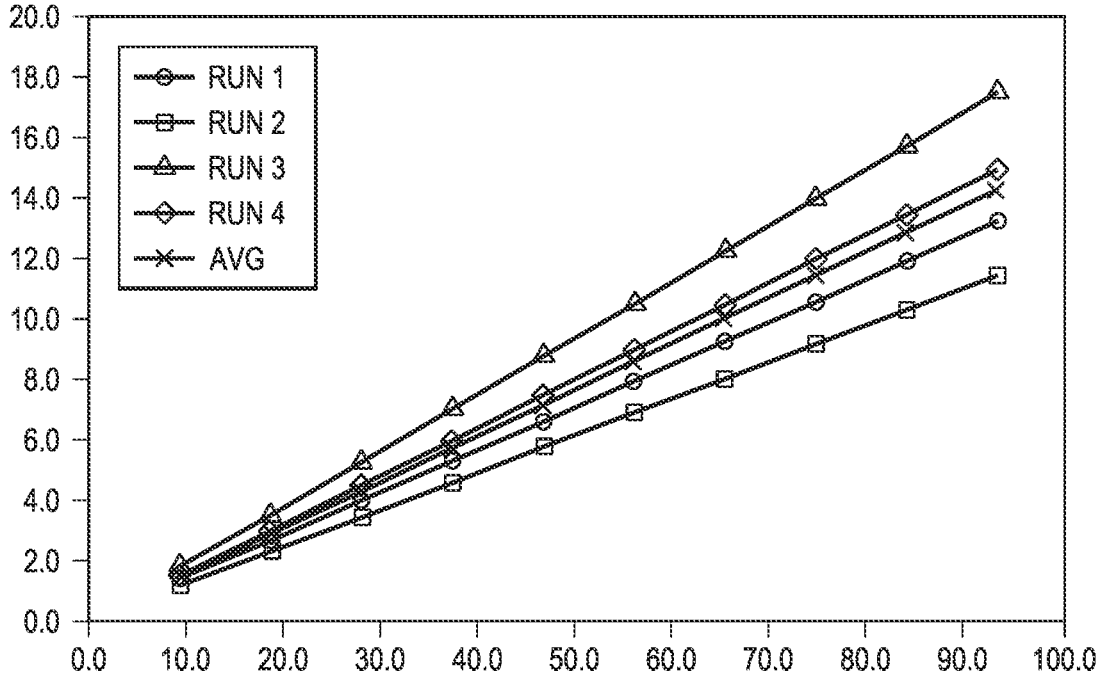
FIG. 9 is a graph related to the method of FIG. 3 according to another aspect of the present disclosure.

In other embodiments, however, "book" values are not available. In these instances, an Actual run is made and then a table, such as the table 800 illustrated in FIG. 8, is built of interpolated and extrapolated values from the single run at a certain ROP. This process is repeated for each actual run and an average DLS profile is then built from the results of all the actual runs and actual ROP's. FIG. 9 illustrates a graphic illustration 900 of interpolation and extrapolation of values for multiple runs.

The method 300 may be altered in a variety of ways. For example, the geometric steering instructions are not limited to instructions on how to drill from a beginning point, but may also include instructions to a target destination. An alternative steering command may be formulated in the format of "steer to an inclination 'x' and an azimuth 'y' at 95 ft ahead of current bottom hole location depth." This could be formatted as: [4/19/18 03:20:57, BHL MD 9124] RSS: Steer 95 ft. to End Inclination=43 deg and End Azimuth=321 deg|ROP ~300 ft/hr|DLS 3.00 [W]. This embodiment may be used for tools that can be steered to an end inclination and end azimuth. As such, the steering command is not limited to a steering vector having the components of a steering force and a toolface direction. In some embodiments, the steering command includes a target setting of an inclination associated with a target location, a target setting of an instantaneous inclination, a target setting of an azimuth associated with a target location, and/or a target setting of an instantaneous azimuth. In instances in which the steering command includes a target inclination and/or target azimuth, the downlink application 205 identifies the target RSS settings associated with the targets and also identifies the downlink command sequences that change the current settings to the identified target RSS settings.

In some embodiments, the navigation application 207 includes or at least forms a portion of the surface control system 190 and/or the downlink application 205. In other embodiments, the navigation application 207 is a separate application from the surface control system 190 and/or the downlink application 205 but is in communication with the surface control system 190 and/or the downlink application 205.

In some embodiments, downlinks may be referred to as code numbers, such as "198," and are used to change a toolface setting of the RSS 178, an inclination setting of the RSS 178, and/or an azimuth setting of the RSS 178. These settings are associated with the RSS being in a specific physical configuration or state. That is, a toolface setting is not required to be expressed in a specific toolface value (expressed in degrees) but may be a configuration of the RSS tool that is expected to result in a specific toolface value on receipt of the downlink known as "198". Similarly, with the inclination and azimuth settings, these settings may be associated with the RSS being in a specific physical configuration or setting that is expected to result in specific inclination and azimuth values. As such, changes in these settings may involve a change in the physical configuration, state, or setting of the RSS.

The downlink application 205 and/or completion of at least a portion of the method 300 provides multiple benefits over conventional systems. In some embodiments, the downlink application 205 and/or completion of at least a portion of the method 300 avoids formatting the downlink instructions to a human-user-friendly format. Instead, the downlink instructions may be expressed in terms of a virtual toolface and a steering force, combined into a steering vector where the magnitude is a pad force %, and the direction is a virtual toolface direction from 0-360. Additionally, the last command sent to the RSS or the current RSS settings is not required to be known. Knowing the last command sent to the RSS or the current RSS settings is not essential to the creation of a new command for downlink instructions by the downlink application 205. The automatic creation and implementation of instructions reduces errors. In some embodiments, the downlink application 205 and/or completion of at least a portion of the method 300 optimizes the amount of time it takes to calculate the geometric instructions to stay or return to the planned trajectory.

Figure 10:
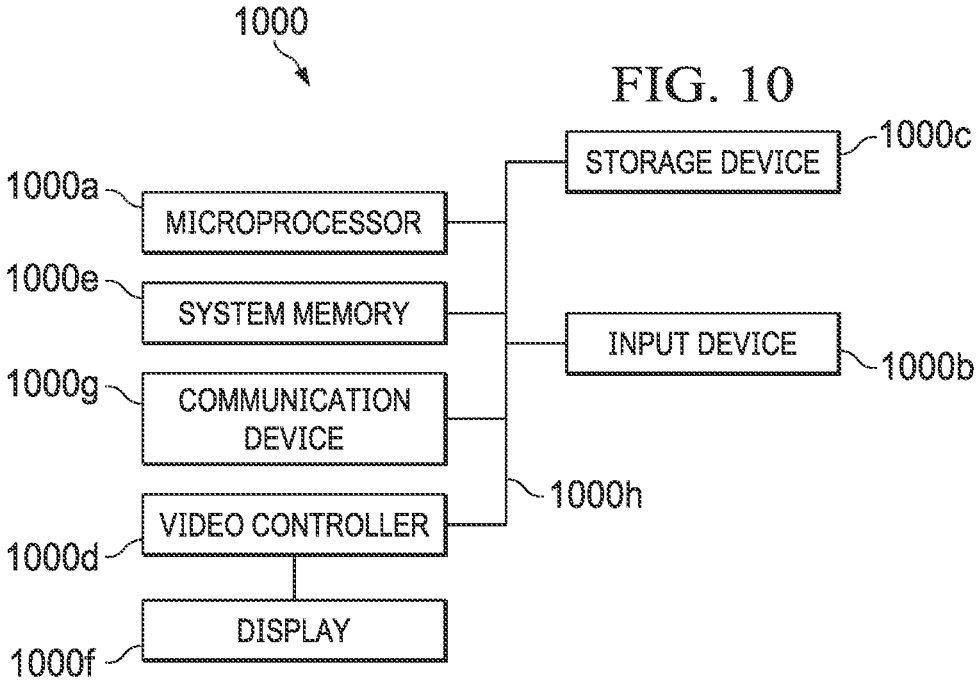
FIG. 10 is a diagrammatic illustration of a node for implementing one or more example embodiments of the present disclosure, according to an example embodiment.

In an example embodiment, as illustrated in FIG. 10 with continuing reference to FIGS. 1-9, an illustrative node 1000 for implementing one or more of the example embodiments described above and/or illustrated in FIGS. 1-9 is depicted. The illustrative node 1000 includes a microprocessor 1000*a*, an input device 1000*b*, a storage device 1000*c*, a video surface control system 1000*d*, a system memory 1000*e*, a display 1000*f*, and a communication device 1000*g* all interconnected by one or more buses 1000*h*. In several example embodiments, the storage device 1000*c* may include a floppy drive, hard drive, CD-ROM, optical drive, any other form of storage device and/or any combination thereof. In several example embodiments, the storage device 1000*c* may include, and/or be capable of receiving, a floppy disk, CD-ROM, DVD-ROM, or any other form of computer-readable medium that may contain executable instructions. In several example embodiments, the communication device 1000*g* may include a modem, network card, or any other device to enable the node to communicate with other nodes. In several example embodiments, any node represents a plurality of interconnected (whether by intranet or Internet) computer systems, including without limitation, personal computers, mainframes, PDAs, smartphones and cell phones.

In several example embodiments, one or more of the components of the systems described above and/or illustrated in FIGS. 1-9 include at least the illustrative node 1000 and/or components thereof, and/or one or more nodes that are substantially similar to the illustrative node 1000 and/or components thereof. In several example embodiments, one or more of the above-described components of the illustrative node 1000, the apparatus 100, and/or the example embodiments described above and/or illustrated in FIGS. 1-9 include respective pluralities of same components.

In several example embodiments, one or more of the applications, systems, and application programs described above and/or illustrated in FIGS. 1-9 include a computer program that includes a plurality of instructions, data, and/or any combination thereof; an application written in, for example, Arena, Hypertext Markup Language (HTML), Cascading Style Sheets (CSS), JavaScript, Extensible Markup Language (XML), asynchronous JavaScript and XML (Ajax), and/or any combination thereof; a web-based application written in, for example, Java or Adobe Flex, which in several example embodiments pulls real-time information from one or more servers, automatically refreshing with latest information at a predetermined time increment; or any combination thereof.

In several example embodiments, a computer system typically includes at least hardware capable of executing machine readable instructions, as well as the software for executing acts (typically machine-readable instructions) that produce a desired result. In several example embodiments, a computer system may include hybrids of hardware and software, as well as computer sub-systems.

In several example embodiments, hardware generally includes at least processor-capable platforms, such as client-machines (also known as personal computers or servers), and hand-held processing devices (such as smart phones, tablet computers, personal digital assistants (PDAs), or personal computing devices (PCDs), for example). In several example embodiments, hardware may include any physical device that is capable of storing machine-readable instructions, such as memory or other data storage devices. In several example embodiments, other forms of hardware include hardware sub-systems, including transfer devices such as modems, modem cards, ports, and port cards, for example.

In several example embodiments, software includes any machine code stored in any memory medium, such as RAM or ROM, and machine code stored on other devices (such as floppy disks, flash memory, or a CD ROM, for example). In several example embodiments, software may include source or object code. In several example embodiments, software encompasses any set of instructions capable of being executed on a node such as, for example, on a client machine or server.

In several example embodiments, combinations of software and hardware could also be used for providing enhanced functionality and performance for certain embodiments of the present disclosure. In an example embodiment, software functions may be directly manufactured into a silicon chip. Accordingly, it should be understood that combinations of hardware and software are also included within the definition of a computer system and are thus envisioned by the present disclosure as possible equivalent structures and equivalent methods.

In several example embodiments, computer readable mediums include, for example, passive data storage, such as a random-access memory (RAM) as well as semi-permanent data storage such as a compact disk read only memory (CD-ROM). One or more example embodiments of the present disclosure may be embodied in the RAM of a computer to transform a standard computer into a new specific computing machine. In several example embodiments, data structures are defined organizations of data that may enable an embodiment of the present disclosure. In an example embodiment, a data structure may provide an organization of data, or an organization of executable code.

In several example embodiments, any networks and/or one or more portions thereof may be designed to work on any specific architecture. In an example embodiment, one or more portions of any networks may be executed on a single computer, local area networks, client-server networks, wide area networks, internets, hand-held and other portable and wireless devices and networks.

In several example embodiments, a database may be any standard or proprietary database software. In several example embodiments, the database may have fields, records, data, and other database elements that may be associated through database specific software. In several example embodiments, data may be mapped. In several example embodiments, mapping is the process of associating one data entry with another data entry. In an example embodiment, the data contained in the location of a character file can be mapped to a field in a second table. In several example embodiments, the physical location of the database is not limiting, and the database may be distributed. In an example embodiment, the database may exist remotely from the server, and run on a separate platform. In an example embodiment, the database may be accessible across the Internet. In several example embodiments, more than one database may be implemented.

In several example embodiments, a plurality of instructions stored on a non-transitory computer readable medium may be executed by one or more processors to cause the one or more processors to carry out or implement in whole or in part the above-described operation of each of the above-described example embodiments of the system, the method, and/or any combination thereof. In several example embodiments, such a processor may include one or more of the microprocessor 1000*a*, any processor(s) that are part of the components of the system, and/or any combination thereof, and such a computer readable medium may be distributed among one or more components of the system. In several example embodiments, such a processor may execute the plurality of instructions in connection with a virtual computer system. In several example embodiments, such a plurality of instructions may communicate directly with the one or more processors, and/or may interact with one or more operating systems, middleware, firmware, other applications, and/or any combination thereof, to cause the one or more processors to execute the instructions.

In several example embodiments, the elements and teachings of the various illustrative example embodiments may be combined in whole or in part in some or all of the illustrative example embodiments. In addition, one or more of the elements and teachings of the various illustrative example embodiments may be omitted, at least in part, and/or combined, at least in part, with one or more of the other elements and teachings of the various illustrative embodiments.

Any spatial references such as, for example, "upper," "lower," "above," "below," "between," "bottom," "vertical," "horizontal," "angular," "upwards," "downwards," "side-to-side," "left-to-right," "right-to-left," "top-to-bottom," "bottom-to-top," "top," "bottom," "bottom-up," "top-down," etc., are for the purpose of illustration only and do not limit the specific orientation or location of the structure described above.

In several example embodiments, while different steps, processes, and procedures are described as appearing as distinct acts, one or more of the steps, one or more of the processes, and/or one or more of the procedures may also be performed in different orders, simultaneously, and/or sequentially. In several example embodiments, the steps, processes and/or procedures may be merged into one or more steps, processes, and/or procedures.

In several example embodiments, one or more of the operational steps in each embodiment may be omitted. Moreover, in some instances, some features of the present disclosure may be employed without a corresponding use of the other features. Moreover, one or more of the above-described embodiments and/or variations may be combined in whole or in part with any one or more of the other above-described embodiments and/or variations and this is within the contemplated scope of disclosure herein, unless stated otherwise.

The phrase "at least one of A and B" should be understood to mean "A, B, or both A and B." The phrases "one or more of the following: A, B, and C" and "one or more of A, B, and C" should each be understood to mean "A, B, or C; A and B, B and C, or A and C; or all three of A, B, and C."

The foregoing outlines features of several implementations so that a person of ordinary skill in the art may better understand the aspects of the present disclosure. Such features may be replaced by any one of numerous equivalent alternatives, only some of which are disclosed herein. One of ordinary skill in the art should appreciate that they may readily use the present disclosure as a basis for designing or modifying other processes and structures for carrying out the same purposes and/or achieving the same advantages of the implementations introduced herein. One of ordinary skill in the art should also realize that such equivalent constructions do not depart from the spirit and scope of the present disclosure, and that they may make various changes, substitutions and alterations herein without departing from the spirit and scope of the present disclosure.

The Abstract at the end of this disclosure is provided to comply with 37 C.F.R. § 1.72(b) to allow the reader to quickly ascertain the nature of the technical disclosure. It is submitted with the understanding that it will not be used to interpret or limit the scope or meaning of the claims.

Although several example embodiments have been described in detail above, the embodiments described are example only and are not limiting, and those of ordinary skill in the art will readily appreciate that many other modifications, changes and/or substitutions are possible in the example embodiments without materially departing from the novel teachings and advantages of the present disclosure. Accordingly, all such modifications, changes and/or substitutions are intended to be included within the scope of this disclosure as defined in the following claims. In the claims, means-plus-function clauses are intended to cover the structures described herein as performing the recited function and not only structural equivalents, but also equivalent structures. Moreover, it is the express intention of the applicant not to invoke 35 U.S.C. § 112(f) for any limitations of any of the claims herein, except for those in which the claim expressly uses the word "means" together with an associated function.

What is claimed is:

1. A method of identifying a steering command for a rotary steerable system ("RSS"), the method comprising:

identifying, by one or more processors, a solution arc for an upcoming drilling segment;

automatically identifying, by the one or more processors and in response to the identification of the solution arc, the steering command for the RSS; and automatically identifying, by the one or more processor and in response to the identification of the steering command, downlink commands to be sent to the RSS.

2. The method of claim 1, further comprising displaying, on a user interface, a selectable option to approve the adoption of the steering command.

3. The method of claim 2, further comprising displaying, on the user interface and with the selectable option to approve the adoption of the steering command, a reason for adopting the steering command.

4. The method of claim 3, wherein the reason for adopting the steering command comprises an indication that a correction is needed to return a bottom hole assembly (BHA) associated with the RSS into a threshold window surrounding a target drilling path.

5. The method of claim 3, wherein the reason for adopting the steering command comprises an indication that a correction is needed to return a BHA associated with the RSS to a target inclination.

6. The method of claim 3, wherein the reason for adopting the steering command comprises an indication that a correction is needed to return a BHA associated with the RSS to a target azimuth.

7. The method of claim 2, further comprising automatically initiating, by the one or more processors and in response to selection of the option to approve the adoption of the steering command, the downlink commands.

8. The method of claim 1, wherein the steering command comprises a target dogleg severity and a target distance.

9. The method of claim 8, wherein the steering command further comprises a target steering force; and wherein automatically identifying, by the one or more processors and in response to the identification of the solution arc, the steering command for the RSS comprises:

accessing a table that models a relationship between a rate of penetration (ROP), dogleg severity, and a percentage of steering force; and identifying, using the table, the target steering force associated with the target dogleg severity.

10. The method of claim 9, further comprising updating, using the one or more processors, the table based on a plurality of historical steering forces and corresponding historical dogleg severities.

11. The method of claim 1, wherein the steering command comprises a target destination and a target orientation at the target destination.

12. A system configured to identify a steering command for a rotary steerable system ("RSS"), the system comprising a non-transitory computer readable medium having stored thereon a plurality of instructions, wherein the instructions are executed with one or more processors so that the following steps are executed:

identify, by one or more processors, a solution arc for an upcoming drilling segment;

automatically identify, by the one or more processors and in response to the identification of the solution arc, the steering command for the RSS; and automatically identify, by the one or more processor and in response to the identification of the steering command, downlink commands to be sent to the RSS.

13. The system of claim 12, wherein the instructions are executed with the one or more processors so that the following step is also executed: display, on a user interface, a selectable option to approve the adoption of the steering command.

14. The system of claim 13, wherein the instructions are executed with the one or more processors so that the following step is also executed: display, on the user interface and with the selectable option to approve the adoption of the steering command, a reason for adopting the steering command.

15. The system of claim 14, wherein the reason for adopting the steering command comprises an indication that a correction is needed to return a bottom hole assembly (BHA) associated with the RSS into a threshold window surrounding a target drilling path.

16. The system of claim 14, wherein the reason for adopting the steering command comprises an indication that a correction is needed to return a BHA associated with the RSS to a target inclination.

17. The system of claim 14, wherein the reason for adopting the steering command comprises an indication that a correction is needed to return a BHA associated with the RSS to a target azimuth.

18. The system of claim 13, wherein the instructions are executed with the one or more processors so that the following step is also executed: automatically initiate, by the one or more processors and in response to selection of the option to approve the adoption of the steering command, the downlink commands.

19. The system of claim 12, wherein the steering command comprises a target dogleg severity, a target distance, and a target steering force; and wherein automatically identifying, by the one or more processors and in response to the identification of the solution arc, the steering command for the RSS comprises:

accessing a table that models a relationship between a rate of penetration (ROP), dogleg severity and a percentage of steering force; and identifying, using the table, the target steering force associated with the target dogleg severity.

20. The system of claim 12, wherein the steering command comprises a target destination and a target orientation at the target destination.

* * * * *